US005771955A

United States Patent [19]

Helgesen et al.

[11] Patent Number: 5,771,955

[45] **Date of Patent: *Jun. 30, 1998**

[54] CORE ASSEMBLY MANUFACTURING APPARATUS OF CASTING ENGINE BLOCKS AND METHOD FOR MAKING THE ASSEMBLY

[75] Inventors: Gary Dale Helgesen, Romulus; Robert Gordon Rentschler, Dearborn; Thomas John Heater, Milford, all of Mich.

[73] Assignee: Ford Global Technologies, Inc., Dearborn, Mich.

[ * ] Notice: The term of this patent shall not extend beyond the expiration date of Pat. No. 5,365,997.

[21] Appl. No.: 286,617

[22] Filed: Aug. 5, 1994

Related U.S. Application Data

[63] Continuation-in-part of Ser. No. 972,793, Nov. 6, 1992, Pat. No. 5,365,997.

[51] Int. Cl.[6] ..... B22C 9/10; B22D 19/00

[52] U.S. Cl. ..... 164/9; 164/11; 164/137; 164/332; 164/333; 164/368; 164/369

[58] Field of Search ..... 164/332, 333, 164/369, 9, 10, 11, 137, 368

[56] References Cited

U.S. PATENT DOCUMENTS

| | | | |
|---|---|---|---|
| 1,309,182 | 7/1919 | Clerget . | |
| 1,528,947 | 3/1925 | Preston . | |
| 2,387,971 | 10/1945 | Aspin et al. . | |
| 3,769,880 | 11/1973 | Mirjanic . | |
| 3,877,126 | 4/1975 | Deutschmann et al. . | |
| 4,284,041 | 8/1981 | Rasch et al. . | |
| 4,337,736 | 7/1982 | Rasch et al. . | |
| 4,495,684 | 1/1985 | Sander et al. . | |
| 4,528,950 | 7/1985 | Obländer et al. . | |
| 4,700,444 | 10/1987 | Yamagata . | |
| 4,711,208 | 12/1987 | Sander et al. | 123/271 |
| 4,738,298 | 4/1988 | Taruno et al. | 164/97 |
| 4,785,522 | 11/1988 | Biro | 29/527.6 |
| 4,817,578 | 4/1989 | Ushio et al. | 123/668 |
| 4,831,712 | 5/1989 | Suzuki et al. | 29/527.6 |
| 4,856,462 | 8/1989 | Ushio et al. | 123/41.84 |
| 4,905,642 | 3/1990 | Suzuki et al. | 123/195 R |
| 4,908,923 | 3/1990 | Anderson et al. | 29/888.01 |
| 4,953,612 | 9/1990 | Sare et al. | 164/102 |
| 4,986,230 | 1/1991 | Panyard et al. . | |
| 5,069,266 | 12/1991 | Nakatani et al. | 164/333 X |
| 5,178,202 | 1/1993 | Dannoura et al. | 164/112 |
| 5,232,041 | 8/1993 | Kuhn | 164/105 |
| 5,361,823 | 11/1994 | Kuhn et al. | 164/332 X |
| 5,365,997 | 11/1994 | Helgesen et al. | 164/103 |

FOREIGN PATENT DOCUMENTS

| | | | |
|---|---|---|---|
| 53-41621 | 4/1978 | Japan . | |
| 56-1258 | 1/1981 | Japan . | |
| 57-146464 | 9/1982 | Japan . | |
| 58-112649 | 7/1983 | Japan . | |
| 58-181464 | 10/1983 | Japan . | |
| 60-102260 | 6/1985 | Japan . | |
| 61-216845 | 9/1986 | Japan . | |
| 62-21454 | 1/1987 | Japan . | |
| 62-110856 | 5/1987 | Japan | 164/369 |
| 63-230926 | 9/1988 | Japan . | |
| 3-42164 | 2/1991 | Japan . | |
| 4-66258 | 3/1992 | Japan | 164/332 |
| 4-135052 | 5/1992 | Japan . | |

*Primary Examiner*—J. Reed Batten, Jr.
*Attorney, Agent, or Firm*—Joesph W. Malleck; Roger L. May

[57] ABSTRACT

A plurality of inter-connected cores includes barrel cores (18). Bore liners (10) surround the barrel cores (18) and are fixed in relation thereto. A cylinder block mold core package (22) is assembled from the cores (14, 24, 26, 28). The liners (10) are heated while they are within the cylinder block mold core package (22) by induction heating. To prevent migration, a mechanical interlock is provided between each liner (10) and its associated barrel core (18).

37 Claims, 6 Drawing Sheets

CORE ASSEMBLY MANUFACTURING APPARATUS OF CASTING ENGINE BLOCKS AND METHOD FOR MAKING THE ASSEMBLY

CROSS-REFERENCE TO RELATED APPLICATION

The present application is a continuation-in-part of application Ser. No. 07/972,793, filed Nov. 6, 1992, now U.S. Pat. No. 5,365,997 which is assigned to the assignee of the present invention.

TECHNICAL FIELD

This invention relates to the cylinders of an internal combustion engine and has particular reference to a process for the construction of cylinders having liners disposed within the bores thereof.

BACKGROUND ART

The cylinder bore walls of internal combustion engines must be made of a material which will provide resistance to the abrasive action of the combustion seal rings of a piston. In traditional cast iron engine blocks, cast iron alone will provide sufficient wear resistance for the life of the engine. However, in applications where a lighter weight engine block material is used, such as aluminum, liners must be inserted into the cylinder bores to provide the required wear resistance.

In the past, there have been various approaches to the "shrink in place" or "press-in" cylinder bore liners. Such approaches include the steps of heating a partially machined cylinder block to 400°–450° F. to expand the cylinder bores. Precision machined liners are then inserted therewithin. As the block cools, the aluminum contracts, and the liners become secured in place.

Other related methods include shrinking the liners by cooling them in a substance such as liquid nitrogen and inserting them into an ambient temperature engine block casting whose bores have been machined to a diameter slightly smaller than the ambient temperature outside diameter of the liner to create an interference fit. Another method, less often used, is simply to press liners, whose outside diameters are slightly larger than the cylinder bores, into engine block castings at ambient temperature.

These processes without modification tend to produce a deficiency in the finished engine which is referred to as liner migration: radial and axial movement of the liner during engine operation.

Another approach commonly used for liner insertion, referred to as cast-in liners, makes the liner an integral part of the engine block casting during the casting process. This can be accomplished using many traditional metal casting processes including die casting, semi-permanent mold and low pressure casting.

In many conventional cast-in liner aluminum block processes, notably those having metal molds, liners are typically preheated with a suitable device (such as a furnace, radiant heater, induction heater, etc.) outside the mold, before mold assembly. Such liners are then installed on mandrels within the mold.

Processes which utilize an all sand core mold render the insertion of liners during mold assembly virtually impossible. This is because the mold assembly requires complex juxtaposition of mating cores, which takes time during which a heated liner would otherwise cool. Earlier experience has led to an interest in determining whether methods might be available to heat the cylinder bore liners within the assembled mold package.

In the past, cast-in liners have been viewed as not being feasible in high volume production using sand casting processes because of the difficulty with heating the liners and inadequate control of liner location. Accordingly, it would be beneficial to have available cast-in liners which would eliminate liner migration and to reduce engine plant facility investment.

Relevant to the goal of economical manufacture of internal combustion engines are the requirements of economy in machining, simplified castings, and ease of assembly. The present invention addresses these requirements in a manner set forth below.

SUMMARY OF THE INVENTION

One aspect of this invention is an engine block casting having integral cylinder bore liners.

The bore liners are inserted within a core box which is adapted for shaping a barrel slab core. The barrel slab core includes a plurality of barrel cores. Surrounding each of the barrel cores is a bore liner so that the liners are integrally formed with the barrel slab core. Each liner includes an anchoring means which mechanically secures it to the barrel core, assures its positional accuracy, and prevents it from migration during preheating.

A cylinder block mold package is assembled from chemically bonded sand cores including the barrel slab cores, end cores, crank case cores, and side cores. Next, the liners are heated while they are within the assembled cylinder block mold package by induction heating. Molten metal, preferably an aluminum or magnesium alloy, is then poured into the cylinder block mold package for forming the engine block casting.

Advantageously, access holes are defined within the barrel slab core, each access hole communicating with the interior of one barrel core. An induction heater is then inserted through each access hole so that thermal energy may be transferred across the barrel core to preheat the bore liner, thus assuring optimum integrity of a bond between a solidified cylinder block casting and each bore liner. The heaters are retracted before adding the molten metal.

Preferably, the induction heater is energized so that it delivers a predetermined amount of energy. The molten metal is added within a predetermined time after the heating step. Preheating the cylinder bore liners tends to avoid the generation of heat sinks which may tend to lead to thermal variations and associated imperfections. As a result, surface contact between the liner and the metal which surrounds it is improved. With induction heating, preheat temperatures are controlled more closely and the time during which the cores are exposed to the heated liners is beneficially reduced.

The present invention will become more fully understood from the detailed description given below and the accompanying drawings.

BEST MODES FOR CARRYING OUT THE INVENTION

Figure 1:
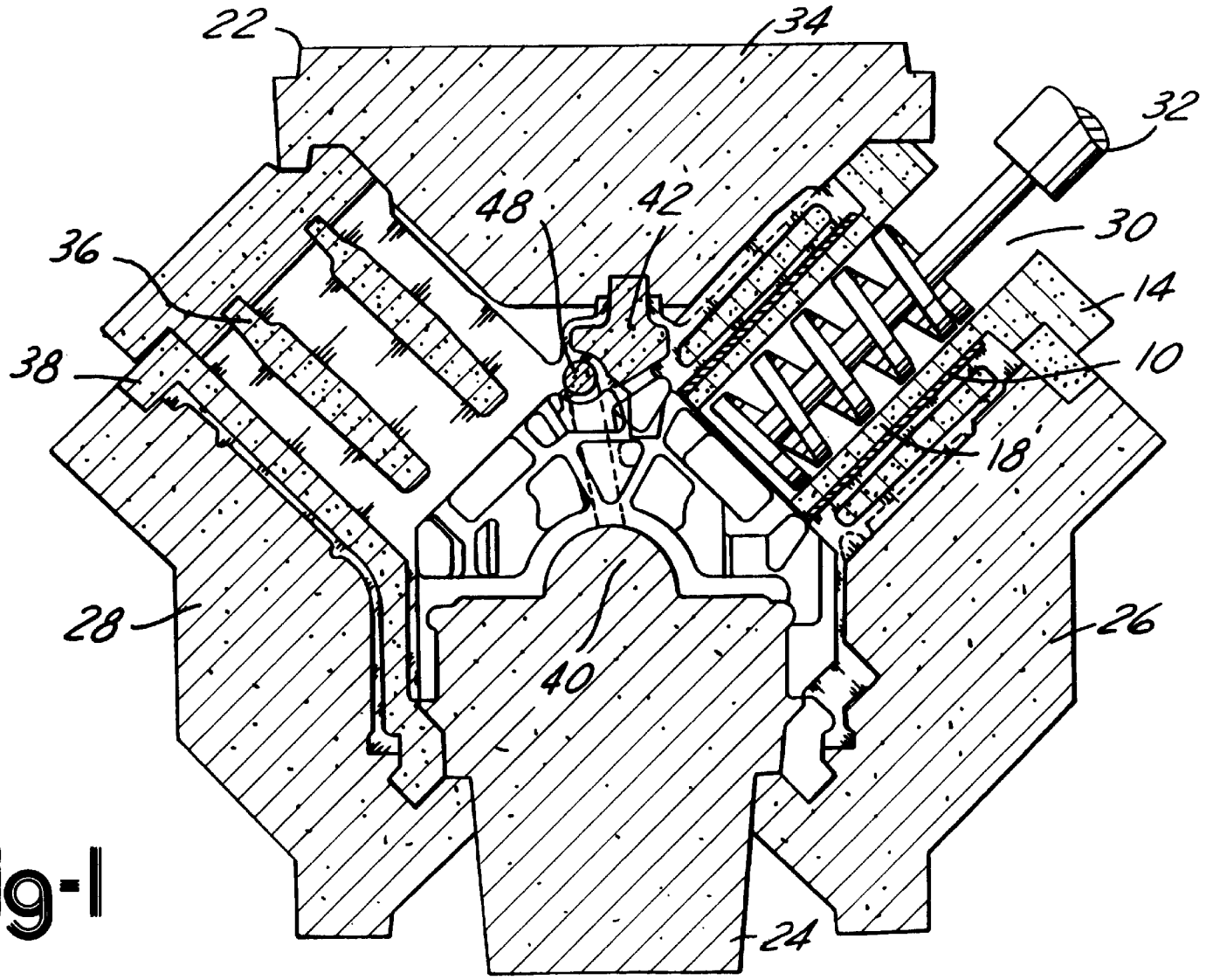
FIG. 1 is a sectional view of a bonded sand cylinder block mold package for forming an engine block casting.
Figure 2:
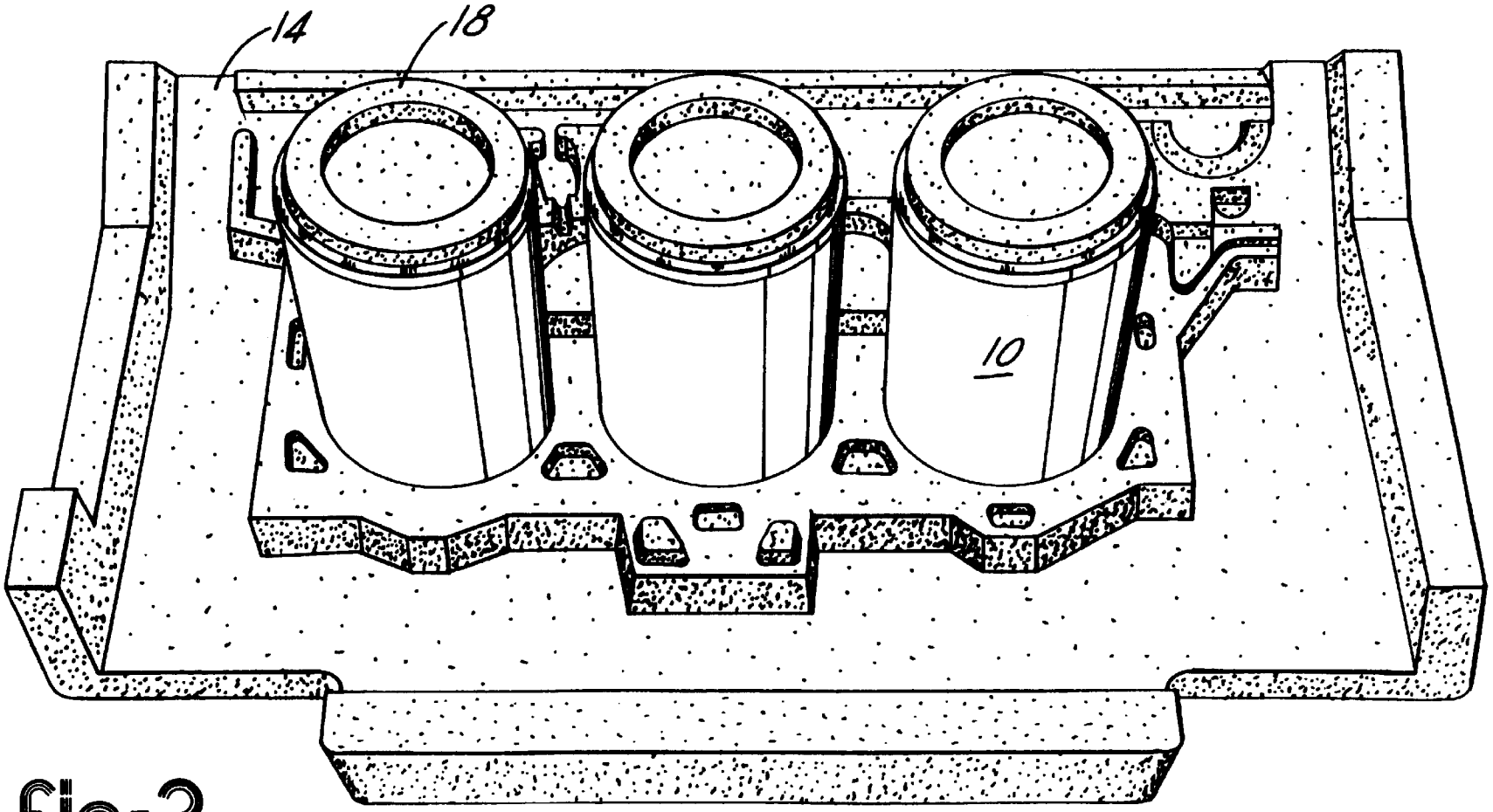
FIG. 2 is a perspective view of a barrel slab core including cylinder bore liners disposed upon the barrel cores thereof.

FIG. 1 depicts a cross-sectional view of a cylinder block mold core package 22. Interposed between a left side core 26 and a valley core 34 is a barrel slab core 14, which is shown also in FIG. 2.

Figure 7:
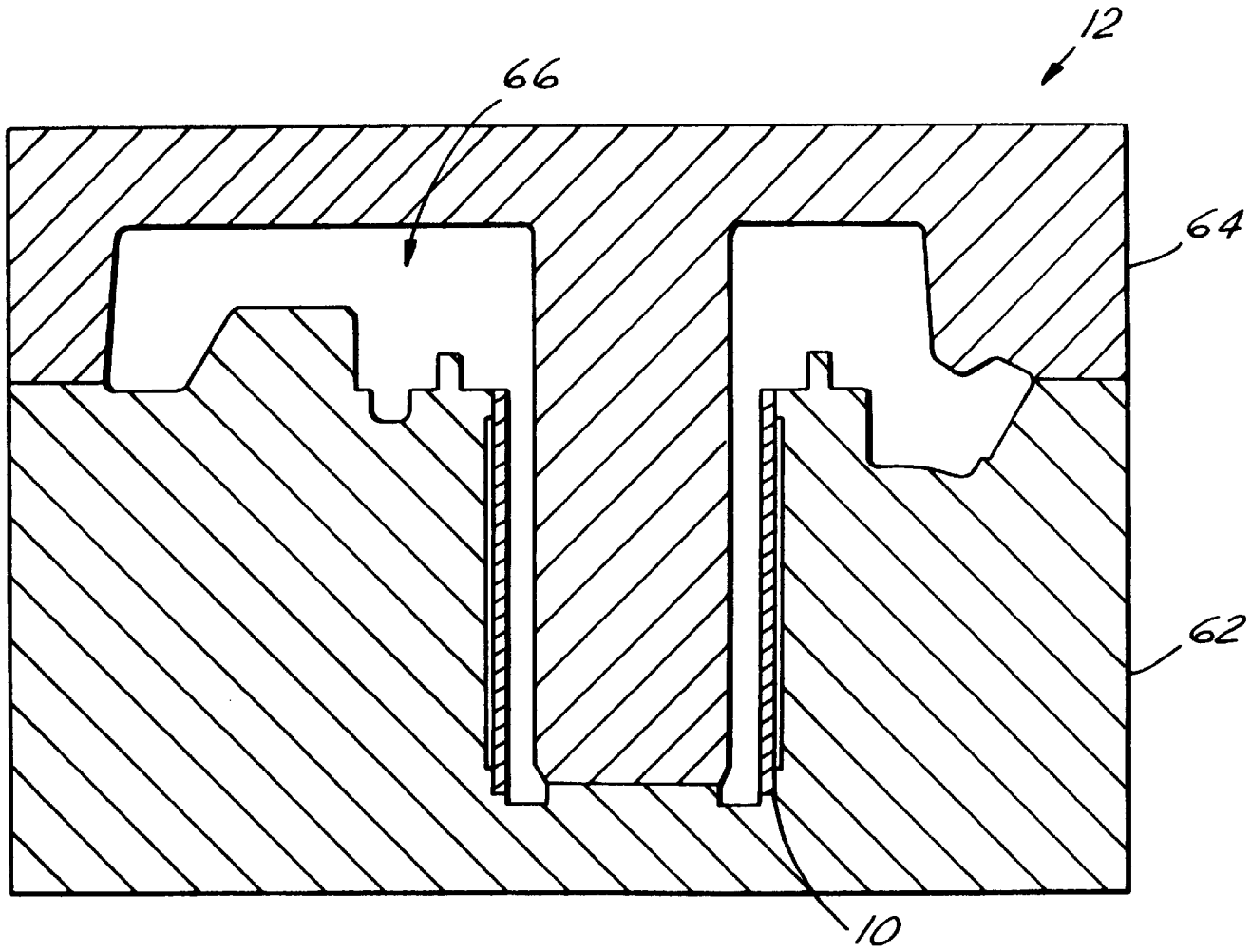
FIG. 7 is a sectional view through a barrel slab core box.

To prepare the barrel slab core base 14 (FIGS. 1 and 2), cast iron cylinder bore liners 10 are positioned in the lower portion 62 of a core box 12 (FIG. 7). The core box 12 includes a core box cover 64 which is placed atop of a lower portion 62 of the core box. Each liner 10, the core box cover 64, and the lower section 62 of the core box, define therebetween a cavity 66 into which a sand mix is blown to form the barrel slab core 14. The top and bottom of the outside diameter of the liner 10 are precision machined (typically to a tolerance of 0.04 mm) for accurate location within the core box. The box 12 is then closed and the core 14 (FIGS. 1 and 2) is produced in a conventional manner using any known core making process, such as a Furan hot box or a phenolic urethane cold box. Cores can be made using any of a variety of sands such as silica, zircon, fused silica, and others. To practice the disclosed invention, the core box 12 was used primarily with zircon. Materials for such processes are available from many suppliers, including Ashland, Acme, Foseco, and McCormick. The disclosed invention was practiced with a urethane cold box process using Ashland Chemical as the resin and catalyst supplier. As with many core-making processes, when the sand and resin are first mixed together, the resin-coated sand is blown into the core box, and then the resin is cured—either chemically, using a catalyst, or with heat—to form a solid core.

When extracted from the core box 12, the barrel slab core 14 includes iron liners 10 on the outside diameter of the barrel cores 18 (FIG. 2), such that the cylinder bore liners 10 form an integral part of the barrel core 18 and of the barrel slab core 14.

In assembling the cylinder block core sand mold package 22 depicted in FIG. 1, the completed barrel slab core 14 is assembled in combination with other cores, including end cores 50 (FIG. 3), crank case cores 24, side cores 26, 28, etc. The cylinder block core sand mold package 22 is then filled with molten metal, such as aluminum.

For orientation (FIGS. 1 and 3), other components of the cylinder block mold package 22 include water jackets 36, an oil drain ladder 38, an oil gallery 40, a vent/breather core 42, and a main oil gallery 48.

Figure 3:
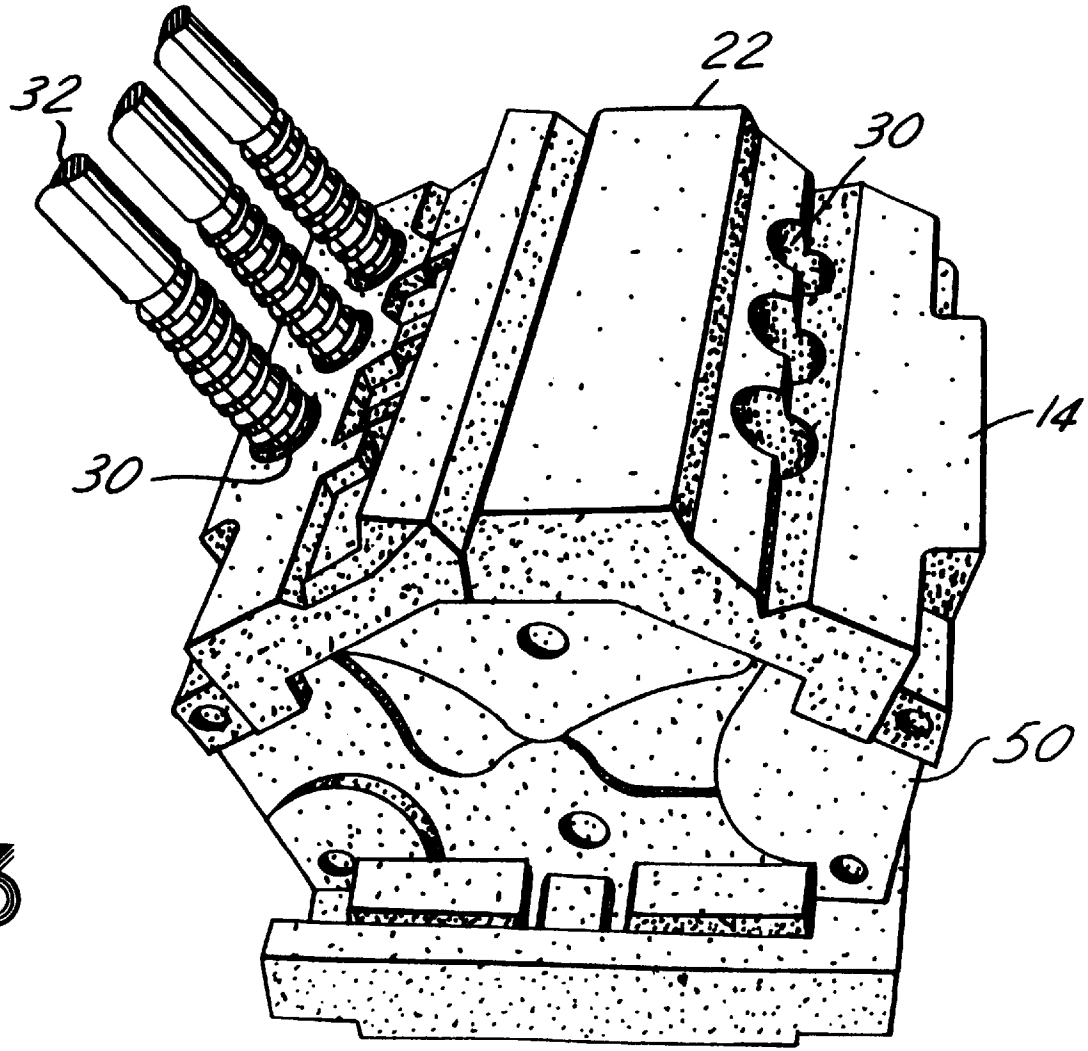
FIG. 3 is a perspective view of the assembled bonded sand cylinder block mold package, illustrating access holes defined within the barrel slab core, through which induction heaters are removably inserted.

Turning now to FIG. 3, there is depicted in perspective the cylinder block mold package 22 including a barrel slab core 14, which defines therewithin access holes 30. Each access hole 30 (see also, FIG. 1) provides communication to an associated barrel core 18.

Induction heaters 32 are removably inserted through access holes 30 with a predetermined longitudinal displacement so as to provide little or no mechanical contact between a leading edge of the induction heater 32 and the floor of associated barrel core 18.

To ensure optimum integrity of the aluminum casting/iron liner interface, the cylinder bore liners 10 are heated (typically for up to 16 seconds to a range of 600°–900° F.) before filling the mold with molten aluminum. Just prior to mold filling, the assembled cylinder mold core package 22 is positioned at an induction heating station. Induction heating coils 32, one for each cylinder, are inserted through the access holes 30 which communicate through the back of the head deck to the interior of the barrel cores 18.

When power is supplied, the coils 32 heat the cylinder bore liners 10 to the desired temperature. The sand of the barrel cores 18 is situated between the heating coil 32 and the associated cylinder bore liner 10. Such sand is invisible to induction heating energy. Accordingly, when power is generated, the coils 32 heat the cylinder bore liners 10 to the desired temperature.

At the end of the heating cycle, the induction heating coils 32 are retracted, and the cylinder block mold package 22 is indexed to the pouring station for metal filling.

Figure 5:
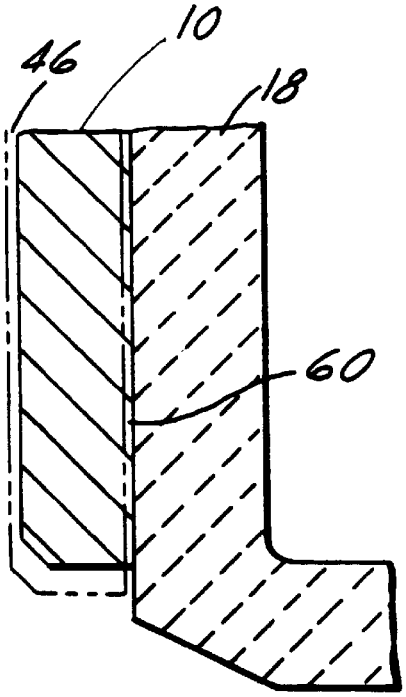
Fig-5 PRIOR ART
FIG. 5 is a partially sectioned view of a barrel core and the cylinder bore liner, illustrating a gap formed therebetween in prior approaches when the liner expands from an unheated to a heated condition.

During mold assembly, if the barrel slab core 14 is aged, the cylinder bore liner 10 may slip off the barrel core 18 due to core shrinkage as curing continues. The need for a more positive method of locating the cylinder bore liners 10 in relation to the barrel slab core 14 is highlighted by the fact that during induction heating, the cylinder bore liner 10 expands under thermal influence. As a result, as depicted in FIG. 5, the cylinder bore liner 10 may become displaced in relation to the barrel core 18 until it comes into contact with a crank case core 24. Accordingly, the cylinder bore liner 10 falls out of position within the cylinder block casting.

Expansion of the cylinder bore liner 10 during induction heating results in a gap 60 being formed between the cylinder bore liner 10 and the barrel core 18. While the cylinder block mold core package 22 is being filled with aluminum, unless sealed, the gap 60 partially fills. The aluminum in the gap 60 is known as flash. During engine block machining, fixtures locate on the iron cylinder bore liners 10. If they locate on the flash instead of the liner, the entire block will be mislocated and machined improperly. The result is a scrapped engine block.

Figure 4:
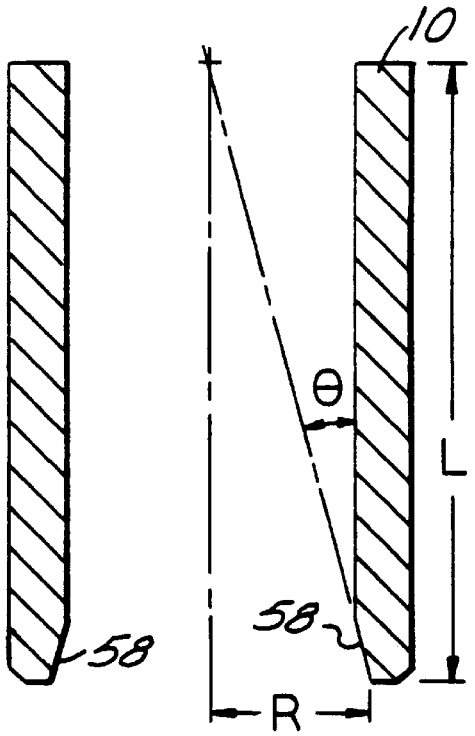
FIG. 4 is an axial sectional view of a cylinder bore liner illustrating an internal diameter chamfer incorporated into the design thereof.

To eliminate such problems, an internal diameter (ID) chamfer 58 (FIGS. 4 and 6) has been incorporated into the cylinder bore liner design 10. The chamfer angle ($\theta$) is determined by the geometric relationship of the length (L) of the cylinder bore liner 10 and its inside radius (R).

The angle ($\theta$) is such that movement of the bottom inside corner of the cylinder bore liner 10 during thermal expansion is constant, both linearly and radially.

With this angle ($\theta$) formed in the cylinder bore liner 10 as a chamfer 58, during heating, the chamfer surface 58 always remains in contact with the barrel core 18. Such continuous contact acts as a seal which prevents aluminum from filling the remaining gap 60 formed above the chamfer 58 (FIG. 6) and prevents the cylinder bore liner 10 from migrating or slipping out of position.

When the barrel core 18 is prepared, its outside diameter is formed by the inside diameter of the cylinder bore liner 10. The ID chamfer 58 of the liner 10 creates an anchoring means 20 (FIG. 6) which is formed from a progressive increment in the diameter of the barrel core 18, thus locking the cylinder bore liner 10 in place in relation thereto.

Additional detail of the ID chamfer 58 will now be provided. The angle (θ) is in part determined by the geometry of the liner 10 and the coefficient of thermal expansion of the liner material. Ideally, the angle (θ) is so selected in relation to the geometry of the liner and the coefficient of thermal expansion that the chamfer 58 securely locks a liner 10 to the barrel core 18 in forming the cylinders of an engine block casting having cast-in place cylinder liners. This mechanical locking feature prevents movement of the liner during mold assembly and casting to assure accurate bore position in the finished casting. This approach contrasts with other sand mold processes in which liners are typically slipped over the barrel cores with no means of preventing liner movement during subsequent processing.

Conventionally, liners are manually assembled and held in place by gravity. In sand molding processes, the liners are slipped over barrel cores attached to either the crankcase or slab cores, depending on the mold configuration. For permanent and semi-permanent molding and die casting, the liners are positioned on cylinder mandrels.

To assure optimum mechanical bonding of the casting metal to the liner, cast-in place liners, are used in light metal engine block casting processes, which do not use high pressure metal filling methods. Such approaches often require pre-heating of the liner to assure optimum mechanical bonding. Two problems frequently encountered during production of these castings when using sand molds are: liner movement and metal flashing entering between the liner and the barrel core. If the cylinder liner is not securely locked to the barrel core, liner movement may result during core handling, mold assembly, liner heating, metal filling and mold handling (e.g. transfer from liner heating to fill and mold roll-over after fill.) Such problems may result in poor bore position accuracy in the finished casting and mislocation during machining. Thermal expansion of the liner during pre-heating often causes a gap to form between the liner ID and the barrel core OD. This gap subsequently fills with casting metal during the metal filling operation, resulting in a heavy coating of casting metal on the ID of the cylinder liner. This is an undesirable machining condition which may also cause mislocation of the casting during machining.

Figure 6:
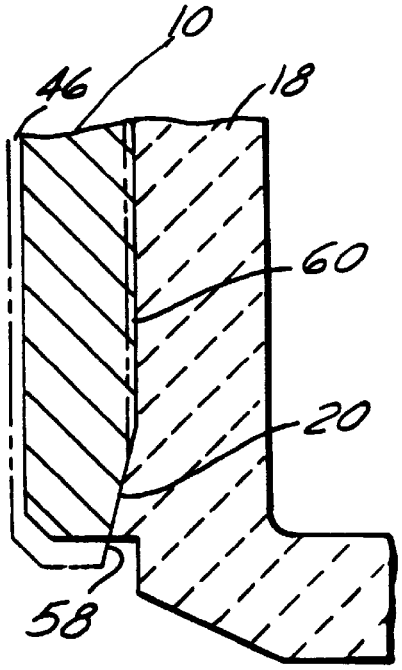
FIG. 6 is a partially sectioned view of the barrel core including an anchoring means which secures the bore liner to the barrel core.

To address such concerns, both problems are overcome by the disclosed invention. As depicted in FIG. 6, one end of the liner 10 has a chamfer 58 machined into its ID. The chamfer, in combination with the sand core of which the liner is an integral part, forms both a lock to prevent liner movement as well as a seal to prevent metal flashing interposing between the liner and the core. To form the lock, the liner is set into the barrel cavity of a core box with the chamfered end of the liner located at the free end of the barrel. Resin-coated sand is then blown into the core box and cured to produce a barrel core with its corresponding cylinder liner locked in place. During the pre-heating operation (FIG. 6), the liner increases in length and diameter as a result of thermal expansion. The liner remains in constant contact with the barrel core at the chamfered edge, throughout the liner heating operation. This keeps the liner locked on-center about the barrel and maintains a seal to prevent liquid metal from entering the gap formed between the liner and the barrel core.

The above concept can be applied to any sand core configuration where a barrel core is used to form an engine block piston cylinder bore. Examples include barrel cores which are part of a combined barrel/head deck slab core and barrel cores which are part of a combined barrel/crankcase core. The concept is not restricted by engine block cylinder arrangement. It is applicable to single cylinder engines as well as any configuration of multiple cylinder engines: such as in-line, 60° V., 90° V. and horizontally opposed.

The angle and width of the chamfer is dependent upon three features of the liner: coefficient of thermal expansion of the liner material, length (L) and inside diameter (2R). The chamfer angle (θ) is determined by dividing the effective expanded liner radius by the liner length at the maximum pre-heat temperature. This value is the tangent of the chamfer angle. Below is an example of the formula and a sample calculation:

$$\mathrm{Tan}\theta = \frac{((D \times CTE \times T) + D + C)/2}{L}$$

where: θ=Chamfer Angle (Degrees)
D=Inside Diameter at Ambient Temperature (mm)
CTE=Coefficient of Thermal Expansion (mm/mm/° F.)
T=Max. Pre-heat Temperature (° F.)
C=Minimum Core Contact Factor (mm)
L=Length (mm)

$$\mathrm{Tan}\theta = \frac{((100 \times 0.00000556 \times 900) + 100 + 2)/2}{150}$$

Tan θ=0.342
θ=18.86°

TABLE I

Typical Chamfer Angles - Cast Iron

| | Inside Diameter (mm) | | |
|---|---|---|---|
| Length (mm) | 75 | 100 | 125 |
| 100 | 21.15 | 27.14 | 32.54 |
| 150 | 14.46 | 18.86 | 23.05 |
| 200 | 10.95 | 14.37 | 17.70 |

For: CTE=0.00000556
T=900
C=2.0

TABLE II

Typical Chamfer Angles - Aluminum

| | Inside Diameter (mm) | | |
|---|---|---|---|
| Length (mm) | 75 | 100 | 125 |
| 100 | 21.26 | 27.27 | 32.70 |
| 150 | 14.54 | 18.97 | 23.17 |
| 200 | 11.01 | 14.45 | 17.80 |

For: CTE=0.00001234
T=900
C=2.0

Figure 8:
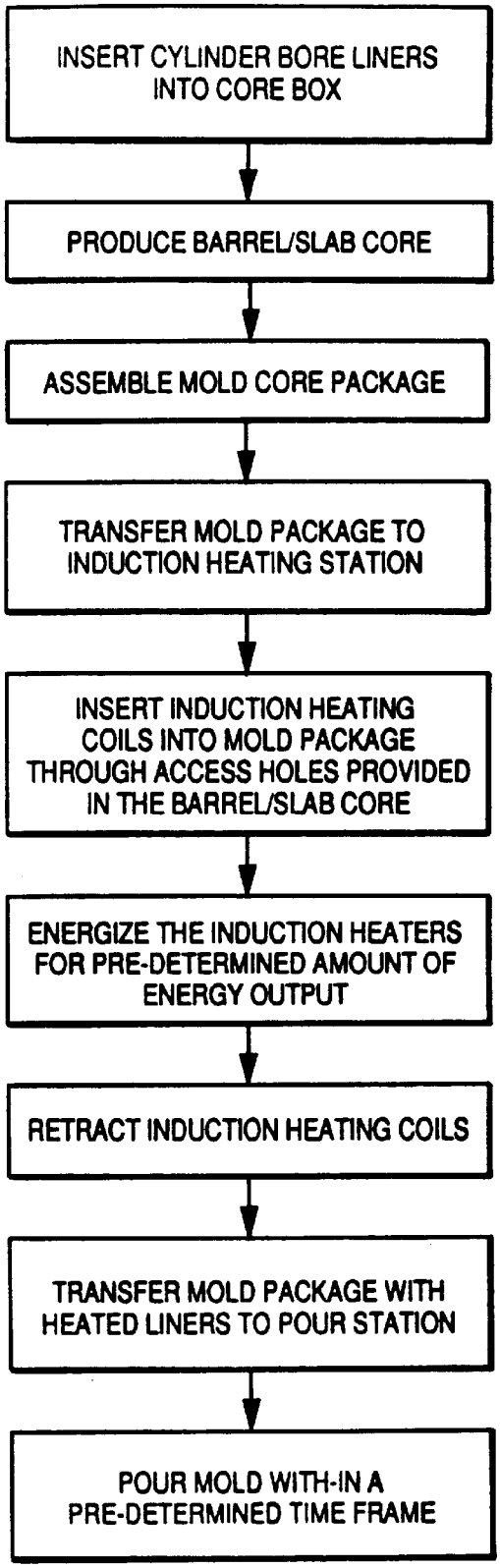
FIG. 8 is a flow diagram of the method steps of the present invention.

FIG. 8 illustrates the major process steps in preparing an engine block casting.

The method comprises the steps of:

(1) inserting the cylinder bore liners 10 within a core box 12 (FIG. 7). The core box 12 defines a cavity 66 which shapes a barrel slab core 14 for forming the cylinder bores within the engine block. The barrel slab core 14 includes barrel cores 18 which are surrounded by the bore liners 10;

(2) the barrel slab core 14 is then removed from the core box with the cylinder bore liners 10, each liner 10 being fixed in relation to the barrel slab core 14;

(3) the cylinder block mold core package 22 is then assembled from the barrel slab core 14, end cores 50, crank case cores 24, and side cores 26, 28;

(4) the cylinder bore liners 10 are then heated while they are within the cylinder block mold package 22 by induction heating; and (5) a molten metal is then poured into the cylinder block mold package 22.

Preferably, the access holes 30 are defined within the back of the barrel slab core 14, each access hole 30 communicating with the interior of one barrel core 18. The heaters 32 are inserted through the access holes 30 so that thermal energy may be transferred across the barrel core 18 to the associated cylinder bore liner 10 to ensure optimum integrity of bonding between a solidified cylinder block casting and the cylinder bore liners. The heaters 32 are then retracted before a melt is added.

Preferably, the heaters 32 are energized so that they deliver a predetermined amount of energy. Experiments have shown that it is proven feasible to heat the cylinder bore liners 10 from ambient temperature to 650° F. in 10 seconds. However, the period of time for which the induction heaters 32 are energized is not necessarily limited to up to 10 seconds. It has been found that the energization period varies depending on cylinder bore diameter, liner thickness, liner o.d. groove pattern, induction heater power output, and metal pouring temperature, among other factors. For example, the recommended heating time to produce an acceptable liner-bore interface for a 2.5 L block casting is about 16 seconds.

Optimally, the molten metal is added to the cylinder block mold core package 22 within a predetermined time after the heating step.

Thus there has been disclosed a method of preparing an engine block casting using cylinder bore liners which are integral with the barrel slab core 14. The cylinder bore liners 10 are secured to the barrel slab core 14 by anchoring means 20 in the form of an ID chamfer 58. When ejected from the core box, the cylinder bore liners 10 are securely located on the outside surface of the barrel cores 18 of the barrel slab core 14.

To avoid prolonged exposure to heat during liner preheating, and consequent deterioration of adjacent mold components (such as a water jacket core 36), induction heaters 32 are inserted through access holes 30 provided within the back of the barrel slab core 14. As a result, it has proven feasible to uniformly heat the cylinder bore liners 10 from ambient temperature to 650° F. in about 10 seconds, thereby minimizing the period of deterioration of the core.

Initial results have shown that the concept of cast-in liner aluminum engine block production is cost effective and represents a superior quality alternative to conventional pressed-in place liner approaches.

While the best mode for carrying out the invention has been described in detail, those familiar with the art to which this invention relates will recognize various alternative designs and embodiments for practicing the invention as defined by the following claims.

What is claimed is:

1. A barrel slab core and liner in combination for use in a cylinder block mold package which is adaptable for forming an engine block casting, the combination comprising:

a slab core;

a plurality of barrel cores for forming piston cylinders extending from the slab core; and an uncoated cylinder bore liner integral with, and surrounding each barrel core, each liner further including:

a chamfered anchoring means disposed upon each cylinder bore liner for securing each liner in relation to one of the plurality of barrel cores.

2. A barrel slab core and liner in combination for use in a cylinder block mold package which is adaptable for forming an engine block casting, the combination comprising:

a slab core;

a plurality of barrel cores for forming piston cylinders extending from the slab core; and an uncoated cylinder bore liner integral with, and surrounding each barrel core, and a chamfered anchoring means disposed upon each cylinder bore liner, wherein the liner is mechanically locked in position in relation to one of the plurality of barrel cores.

3. A barrel slab core and liner in combination for use in a cylinder block mold package which is adaptable for forming an engine block casting, the combination comprising:

a slab core;

a plurality of barrel cores for forming piston cylinders extending from the slab core; and an uncoated cylinder bore liner integral with, and surrounding each barrel core, each liner further including:

a chamfered anchoring means disposed upon each cylinder bore liner for securing each liner in relation to one of the plurality of barrel cores, wherein the anchoring means comprises:

a chamfer disposed on the inside of the cylinder bore liner so that an interface between the chamfer and one of the plurality of barrel cores forms a continuous contact which blocks the passage of molten metal into the gap formed between the outside diameter of the barrel core and an inside diameter of the cylinder bore liner and prevents the cylinder bore liner from slipping out of position, the chamfer including:

a chamfer angle (θ) which is defined as:

$$\mathrm{Tan}\theta = \frac{((D \times CTE \times T) + D + C)/2}{L}$$

where: θ=Chamfer Angle (Degrees)

D=Inside Diameter at Ambient Temperature (mm)

CTE=Coefficient of Thermal Expansion (mm/mm/° F.)

T=Max. Pre-heat Temperature (° F.)

C=Minimum Core Contact Factor (mm)

L=Length (mm).

4. The combination of claim 3 wherein the liner is made of cast iron and the chamfer angle is between 21°–32° for a liner length (L) of 100 millimeters.

5. The combination of claim 3 wherein the liner is made of cast iron and the chamfer angle is between 18°–24° for a liner length (L) of 150 millimeters.

6. The combination of claim 3 wherein the liner is made of cast iron and the chamfer angle is between 10°–18° for a liner length (L) of 200 millimeters.

7. The combination of claim 3 wherein the liner is made of aluminum and the chamfer angle is between 21°–33° for a liner length (L) of 100 millimeters.

8. The combination of claim 3 wherein the liner is made of aluminum and the chamfer angle is between 14°–24° for a liner length (L) of 150 millimeters.

9. The combination of claim 3 wherein the liner is made of aluminum and the chamfer angle is between 11°–18° for a liner length (L) of 200 millimeters.

10. A casting core assembly for use in the manufacture of cast metal cylinder blocks for internal combustion engines, said core assembly comprising:

a casting core having a base portion, and a piston cylinder chamber-forming main body portion integral with and extending longitudinally from said base portion, said casting core being formed of reducible refractory material for accommodation within a mold cavity of a cylinder block casting mold for forming a piston cylinder chamber in a cylinder block cast within the mold;

a tubular liner member disposed about said main body portion for support within the mold cavity and cast-in-place joiner with the cylinder block for lining the piston cylinder chamber with said liner member, said liner member having opposite ends, an inner wall surface, and an outer wall surface, one end of said liner member being disposed in abutting engagement with said base portion for securing said liner member against longitudinal sliding movement on said main body portion toward said base portion; and said casting core having mechanical interlocking means integral with said main body portion, said mechanical interlocking means extending into said inner wall surface of said liner member and spaced radially from said outer wall surface between said ends of said liner member for locking said liner member against longitudinal sliding movement along said main body portion away from said base portion.

11. An assembly as set forth in claim 10 further characterized by said interlocking means comprising a projection formed on the outer surface of said main body portion and a corresponding recess formed on the inner surface of the liner member.

12. An assembly as set forth in claim 11 further characterized by said projection and said recess being annular.

13. An assembly as set forth in claim 12 further characterized by said recess being formed adjacent one of said ends of said liner member.

14. An assembly as set forth in claim 10 further characterized by said liner member having continuous walls.

15. An assembly as set forth in claim 10 further characterized by including heating means disposed within said main body portion for heating said liner member.

16. An assembly as set forth in claim 15 further characterized by the main body portion having a central recess formed therein.

17. An assembly as set forth in claim 16 further characterized by said heating means being disposed within recess.

18. An assembly as set forth in claim 15 further characterized by said heating means comprising an induction heater.

19. An assembly as set forth in claim 15 further characterized by said heating means and said main body portion being separable.

20. An assembly as set forth in claim 10 further characterized by said refractory material comprising foundry sand.

21. An assembly as set forth in claim 10 further characterized by said liner member being fabricated of cast iron metal.

22. A casting mold assembly for use in the manufacture of a cast metal cylinder block for an internal combustion engine, said assembly comprising:

a cylinder block casting mold;

a piston cylinder chamber-forming core fabricated of decomposable refractory material separately from said mold and extending into a cavity of said mold for forming a piston cylinder chamber within a cylinder block cast within said mold, said core having a base portion and a main body portion integral with and extending longitudinally from said base portion;

a tubular liner member disposed about said main body portion of said casting core for cast-in-place joiner with the cylinder block for lining the piston cylinder chamber of the block with said liner member, said liner member having opposite ends, an inner wall surface, and an outer wall surface, one end of said liner member being disposed in abutting engagement with said base portion for securing said liner member against longitudinal sliding movement on said main body portion toward said base portion; and said casting core having mechanical interlocking means integral with said main body portion, said mechanical interlocking means formed between said ends of said liner member extending into said inner wall surface of said liner member and spaced radially from said outer wall surface for mechanically locking said liner member against longitudinal sliding movement along said main body portion away from said base portion.

23. An assembly as set forth in claim 22 further characterized by the interlocking means comprising a projection formed on the outer surface of the main body portion of the core and a corresponding recess formed on the inner surface of said liner member.

24. An assembly as set forth in claim 23 further characterized by said projection and said recess being annular.

25. An assembly as set forth in claim 23 further characterized by said casting core being suspended in said cavity with one of said ends of said liner member being lower than the other.

26. An assembly as set forth in claim 25 further characterized by said recess being formed adjacent the lower end of said liner member.

27. An assembly as set forth in claim 26 further characterized by said liner member having continuous walls.

28. An assembly as set forth in claim 22 further characterized by including heating means disposed within said main body portion for heating said liner member.

29. An assembly as set forth in claim 28 further characterized by the main body portion having a central recess formed therein.

30. An assembly as set forth in claim 29 further characterized by said heating means being disposed in said recess.

31. An assembly as set forth in claim 28 further characterized by said heating means comprising an induction heater.

32. An assembly as set forth in claim 28 further characterized by said heating means and said main body portion being separable.

33. An assembly as set forth in claim 22 further characterized by said refractory material comprising foundry sand.

34. An assembly as set forth in claim 22 further characterized by said liner member being fabricated of cast iron metal.

35. A method of producing a casting core assembly for use in the manufacture of a cylinder block for forming and lining a piston cylinder chamber of the block with a tubular metal liner member, said method comprising the steps of:

forming a recess on the liner member extending into an inner surface of the liner member and spaced radially from an outer surface of the liner member;

disposing the liner member within a piston cylinder core-forming cavity of a core box;

introducing refractory particulate material and binder core mixture into the core box cavity and against the inner surface of the liner member to fill the recess with a projection of the core mixture; and curing the core mixture in situ with the liner member to produce a base portion of the piston cylinder core that engages one end of the liner member to prevent longitudinal movement of the liner member toward the base portion, and to produce an inner main body portion integral with the base portion and projection and extending longitudinally from the base portion into the liner member such that the core projection and liner recess mechanically interlock at a location wholly within the confines of the liner member to prevent the liner member from sliding longitudinally on the main body portion away from the base portion.

36. A method as set forth in claim 35 wherein the step of forming the recess comprises machining an annular recess into the inner surface of the liner member.

37. A method as set forth in claim 36 including machining the annular recess adjacent an end of the liner member.

* * * * *